US009929492B2

(12) United States Patent
Chuang et al.

(10) Patent No.: US 9,929,492 B2
(45) Date of Patent: Mar. 27, 2018

(54) COMPOSITE ELECTRONIC CONNECTOR

(71) Applicants: NICECONN TECHNOLOGY CO., LTD., New Taipei (TW); Yi-Fang Chuang, New Taipei (TW); Nai-Chien Chang, New Taipei (TW)

(72) Inventors: Yi-Fang Chuang, New Taipei (TW); Nai-Chien Chang, New Taipei (TW)

(73) Assignees: NICECONN TECHNOLOGY CO., LTD., New Taipei (TW); Yi-Fang Chuang, New Taipei (TW); Nai-Chien Chang, New Taipei (TW)

( * ) Notice: Subject to any disclaimer, the term of this patent is extended or adjusted under 35 U.S.C. 154(b) by 0 days.

(21) Appl. No.: 15/352,044

(22) Filed: Nov. 15, 2016

(65) Prior Publication Data

US 2017/0179658 A1 Jun. 22, 2017

(30) Foreign Application Priority Data

Dec. 16, 2015 (TW) ..... 104220219 U

(51) Int. Cl.

| | |
|---|---|
| ***H01R 13/502*** | (2006.01) |
| ***H01R 24/60*** | (2011.01) |
| ***H01R 24/62*** | (2011.01) |
| ***H01R 13/66*** | (2006.01) |
| ***H01R 12/72*** | (2011.01) |
| ***H01R 27/02*** | (2006.01) |
| *H01R 107/00* | (2006.01) |

(52) U.S. Cl.

CPC ..... *H01R 13/502* (2013.01); *H01R 12/724* (2013.01); *H01R 13/665* (2013.01); *H01R 24/60* (2013.01); *H01R 24/62* (2013.01); *H01R 27/02* (2013.01); *H01R 2107/00* (2013.01)

(58) Field of Classification Search

CPC ..... H01R 13/502; H01R 24/60; H01R 24/62; H01R 13/665

USPC ..... 439/620.52

See application file for complete search history.

(56) References Cited

U.S. PATENT DOCUMENTS

| | | | | |
|---|---|---|---|---|
| 7,044,779 | B1 * | 5/2006 | Liu | H01R 24/62 439/540.1 |
| 8,152,564 | B2 * | 4/2012 | Chang | H01R 13/6658 439/607.01 |
| 8,182,283 | B2 * | 5/2012 | Chang | H01R 12/724 439/541.5 |
| 8,485,851 | B2 * | 7/2013 | Kondo | H01R 13/6474 439/660 |
| 9,214,765 | B2 * | 12/2015 | Zheng | H01R 13/6581 |

(Continued)

*Primary Examiner* — Alexander Gilman

(74) *Attorney, Agent, or Firm* — Chun-Ming Shih; HDLS IPR Services

(57) ABSTRACT

A composite electronic connector comprising an insulating housing, a USB Type-C connector and a USB Type-A connector which are arranged in the insulating housing is disclosed. The USB Type-C connector comprises a circuit board, a connecting line and a plurality of transferring terminals. One side of the circuit board is arranged with twenty-four golden fingers, other side of the circuit board is connected with the plurality of transferring terminals. The connecting line is used to integrate signal transmitted through the twenty-four golden fingers of the USB Type-C connector into USB Type-A standard adopted outputting signal, and outputs the outputting signal through the plurality of transferring terminals.

9 Claims, 6 Drawing Sheets

1

(56) References Cited

U.S. PATENT DOCUMENTS 9,318,856 B2 * 4/2016 MacDougall ..... H01R 13/6581
9,402,308 B2 * 7/2016 Goodwin
9,455,535 B1 * 9/2016 Chiang ..... H01R 13/6585
9,515,442 B2 * 12/2016 Cymerman ..... H01R 31/06
9,531,142 B2 * 12/2016 Xu ..... H01R 13/6594
9,577,372 B1 * 2/2017 Kakish ..... H01R 13/6205
9,577,392 B2 * 2/2017 Chang ..... H01R 24/60
9,583,900 B2 * 2/2017 Cheng ..... H01R 4/023
2010/0159746 A1 * 6/2010 Wan ..... H01R 12/712 439/607.11
2011/0095767 A1 * 4/2011 Motter ..... H04L 12/2697 324/539
2014/0106590 A1 * 4/2014 Wu ..... H01R 27/00 439/284
2014/0106623 A1 * 4/2014 Wu ..... H01R 31/06 439/638
2014/0273581 A1 * 9/2014 McSweyn ..... H01R 27/02 439/300
2014/0273644 A1 * 9/2014 Mcsweyn ..... H01R 27/00 439/628
2015/0163944 A1 * 6/2015 Goodwin ..... H05K 7/1053 361/679.33
2015/0244111 A1 * 8/2015 Ju ..... H01R 13/6585 439/607.05
2015/0288107 A1 * 10/2015 Wu ..... H01R 13/6593 439/357
2015/0346790 A1 * 12/2015 Talmola ..... G06F 1/266 710/104
2016/0013595 A1 * 1/2016 Kao ..... H01R 13/6591 439/607.55
2016/0013599 A1 * 1/2016 Ueda ..... H01R 13/6596 439/607.01
2016/0093994 A1 * 3/2016 Chen ..... H01R 12/724 439/607.01
2017/0005447 A1 * 1/2017 Kim ..... H01R 13/6616
2017/0033513 A1 * 2/2017 Bae ..... H01R 13/6616

* cited by examiner

COMPOSITE ELECTRONIC CONNECTOR

BACKGROUND OF THE INVENTION

1. Techincal Field

The present invention relates to an electronic connector, and in particular to a composite electronic connector combined by multiple connectors.

2. Description of Prior Art

Due to the development of the electronics industry, many types of electronic devices are now popular and surronding people's life. In order to transmit control commmands, multimedia data and power, most electronic devices are arranged with at least one electrical connector.

The most popular electrical connector in the market is universal serial bus (USB) connector. General speaking, the most popular USB connector is USB Type-A connector. Besides, USB Micro-B connector is another USB interface which is smaller than USB Type-A connector, and is mostly adopted in portable devices such as smart phones, tablets, etc. Furthermore, USB Implementers Forum announced USB Type-C interface, which is made for slighter, thinner devices.

In order to save the arranging space of the mainboard, most computers (such as laptops or PCs) are arranged with one or more composite electronic connectors. In particular, the most popular composite electronic connector is the connector that combined by two USB 3.0 Type-A connectors or one USB 3.0 Type-A connector and one USB 2.0 Type-A connector.

A skilled person in the technical field may know the amount of the terminals in a USB 3.0 Type-A connector is nine, the amount of the terminals in a USB 2.0 Type-A connector is four, and the amount of the terminals in a USB Type-C connector is twenty-four. As a result, if a current composite electronic connector needs to be update to combine a USB Type-C connector with a USB 3.0 Type-A connector, or to combine a USB Type-C connector with a USB 2.0 Type-A connector, the pin difinition of a mainboard of a computer needs to be changed following USB 3.1 Type-C standard (for example, traditional pin difinition, such as nine pins plus nine pins or nine pins plus four pins, needs to be changed into, for example, nine pins plus twenty-four pins or four pins plus twenty-four pins). Besides, the circuit design of the mainboard also needs to be extremely adjusted. Therefore, the cost of development and manufacture of the mainboard will be increased.

SUMMARY OF THE INVENTION

The present invention is to provide a composite electronic connector, which may connect with a mainboard through inserting holes adopted with USB Type-A standard and make the mainboard to use a USB Type-C connector of the composite electronic connector.

In one of the exemplary embodiments, the composite electronic connector comprises an insulating housing, a USB Type-C connector and a USB Type-A connector which are arranged in the insulating housing. The USB Type-C connector comprises a circuit board, a connecting line and a plurality of transferring terminals. One side of the circuit board is arranged with twenty-four golden fingers, other side of the circuit board is connected with the plurality of transferring terminals. The connecting line is used to integrate signal transmitted through the twenty-four golden fingers of the USB Type-C connector into USB Type-A standard adopted outputting signal, and outputs the outputting signal through the plurality of transferring terminals.

In comparison with prior art, the composite electronic connector of the present invention may connect with an external mainboard through USB Type-A adopted inserting holes, so as to connect with the mainboard and make the mainboard to use the USB Type-C connector on the composite electronic connector without changing the circuit arrangement of the mainboard, which is very convenient.

DETAILED DESCRIPTION OF THE INVENTION

In cooperation with the attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
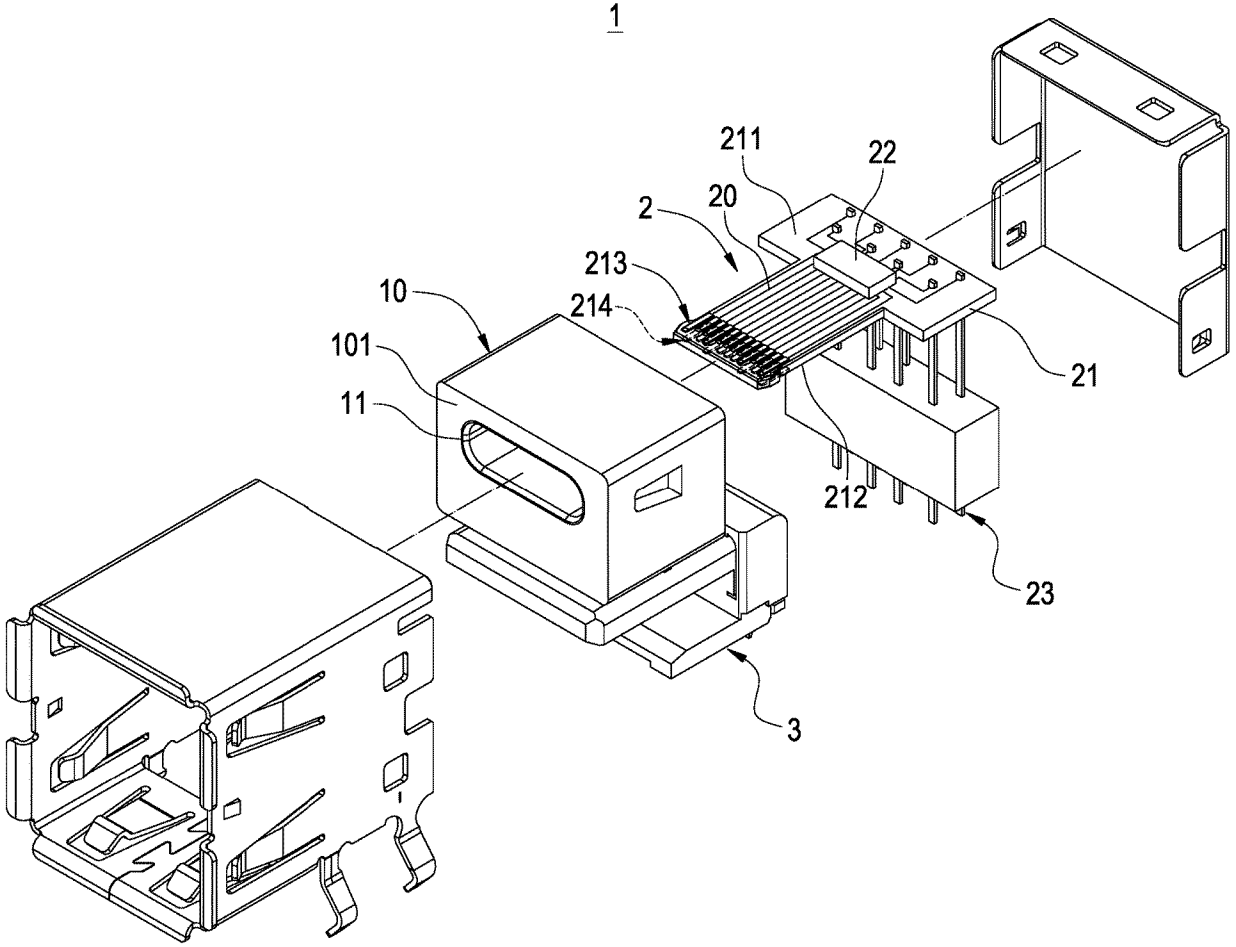
FIG. 1 is a perspective view of a first embodiment according to the present invention.
Figure 2:
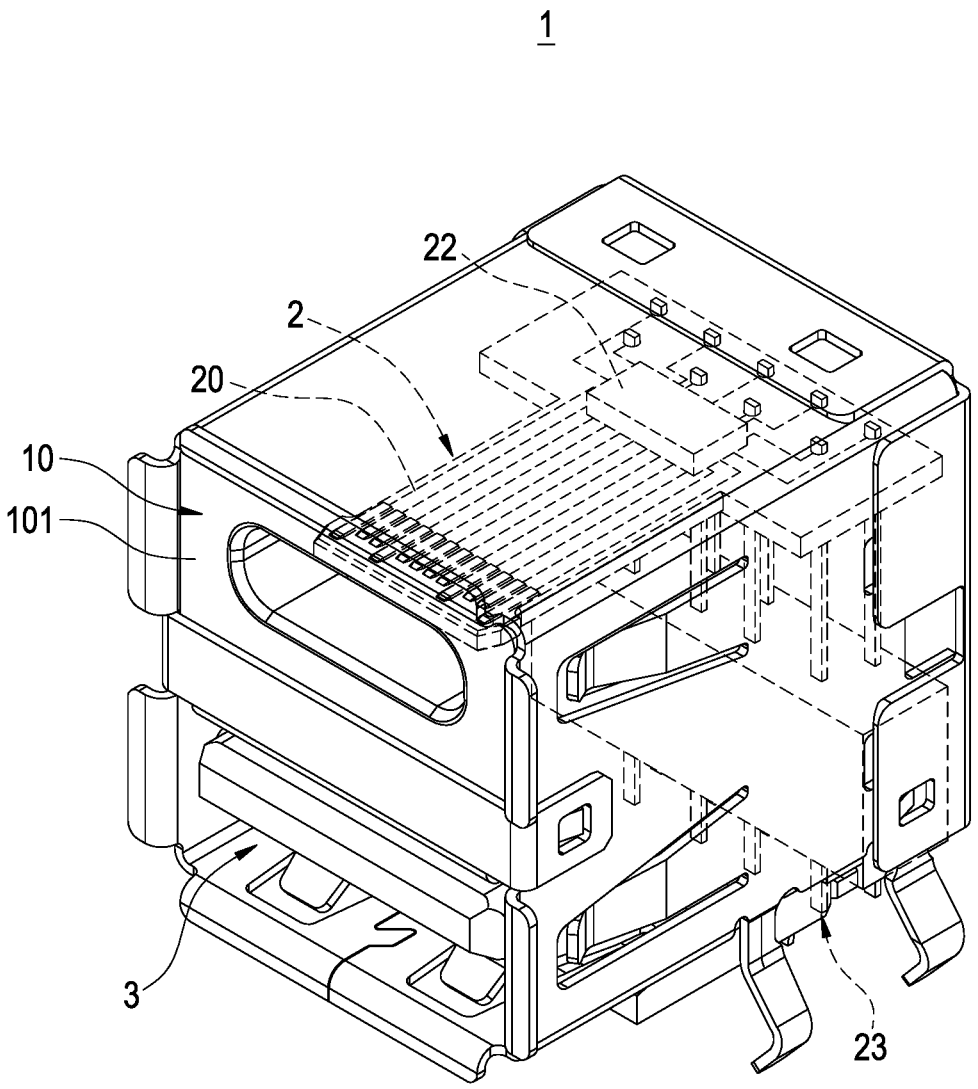
FIG. 2 is a schematic view of a first embodiment according to the present invention.
Figure 3:
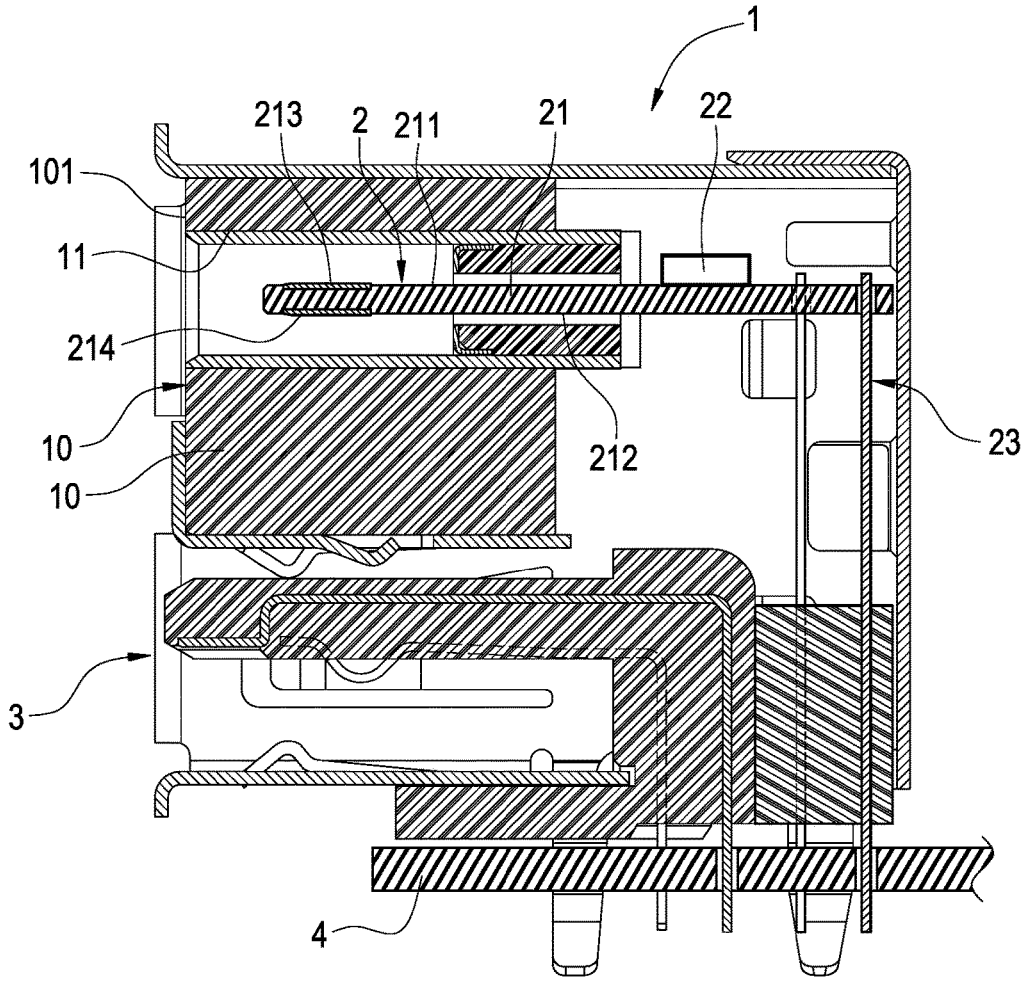
FIG. 3 is a side view of a first embodiment according to the present invention.

Please refer to FIG. 1, FIG. 2 and FIG. 3, which are respectively a perspective view, a schematic view and a side view of a first embodiment according to the present invention. As shown in the figures, the present invention discloses an improved composite electronic connector (refers to as the connector assembly 1 hereinafter), the connector assembly 1 comprises an insulating housing 10, a first connector and a second connector which are arraned in the insulating housing 10. In one embodiment, the first connector may be a USB Type-C connector 2, and the second connector may be a USB Type-A connector 3, but not limited thereto.

As shown in FIG. 1, the USB Type-C connector 2 may be a USB 3.1 Type-C connector. In one embodiment, the USB Type-C connector 2 is implemented by a circuitboard, which comprises twenty-four golden fingers thereon. In paticular, the USB Type-C connector 2 in each exemplary embodiments of the present invention uses the circuit board to substitute for a tongue of a standard USB Type-C connector, and uses the twenty-four golden fingers of the circuit board to substitute for twenty-four terminals of the standard USB Type-C connector.

In one embodiment, the USB Type-A connector 3 may be a USB 3.0 Type-A connector, which comprises nine connection terminals. However, in other embodiments, the USB Type-A connector 3 may be a USB 2.0 Type-A connector which comprises only four connection terminals, not limited thereto.

As shown in the fingures, both the USB Type-C connector 2 and USB Type-A connector 3 are arranged in the insulating housing 10, and the USB Type-A connector 3 is arranged approximately to the USB Type-C connector 2. In one embodiment, the USB Type-A connector 3 and the USB Type-C connector 2 are horizontally arranged in the insulating housing 2. More specific, the USB Type-A connector 3 is horiontally arranged below the insulating housing 10, but not limited thereto.

In particular, the insulating housing 10 is arranged with a container 11 inside the insulating housing 10. In one aspect, the USB Type-C connector 2 is horizontally arranged in the container 11, and the USB Type-A connector 3 is horizontally arranged below the USB Type-C connector 2.

As shown in FIG. 1, the insulating housing 10 comprises a front face 101, the USB Type-C connector 2 is arranged in the container 11 and exposed out of the front face 101. In one aspect, the size and the shape of the front face 101 are the same as that of a front face of a standard USB Type-A connector.

The USB Type-C connector 2 may comprise a circuit board 21, a connecting line 20 and a plurality of transferring terminals 23. The circuit board 21 may be horizonally arranged in the container 11, and one end of the circuit board is arranged with twenty-four golden fingers. One end of the plurality of transfering terminals 23 are electrically connected with the other end of the circuit board 21, and the other end of the plurality of tranferring terminals 23 are protruding from the bottom of the insulating housing 10.

In one embodiment, the amount of the plurality of transferring terminals 23 is the same as that of connection terminals of the USB Type-A connector 3 (which may be nine in this embodiment), but not limited. In other embodiments, the amount of the plurality of transferring terminals 23 may be corresponding to that of connetction terminals of other types of USB Type-A connector, for example, it may be four (which is corresponding to the amount of connection terminals in a USB 2.0 Type-A connector) or nne (which is corresponding to the amount of connection terminals in a USB 3.0 Type-A connector).

The circuit board 21 comprises a top face 211 and a bottom face 212, wherein the twenty-four golden fingers comprises twelve upper golden fingers 213 arraned on the top face 211 of the circuit board 21 and twelve lower golden fingers 214 arranged on the bottom face 212 of the circuit board 21.

In one embodiment, the connecting line 20 is electrically connected with the plurality of golden fingers 213, 214 and the plurality of transferring terminals 23, therefore, the connecting line 20 may integrate signal transmitted by the USB Type-C connector 2 through the twenty-four golden fingers into USB Type-A standard adopted outputting signal, and transmits the integrated outputting signal externally through the plurality of transferring terminals 23. Also, the connecting line 20 receives USB Type-A standard adopted input signal from an external mainboard 4 through the plurality of transferring terminals 23, and processes the received input signal to be transmitted by the twenty-four golden fingers, then transmits it externally through the USB Type-C connector 2. In this embodiment, the aforementioned integrated procedure is to perform a parallel connection to same signal, but not limited thereto.

As shown in FIG. 1, the USB Type-C connector 2 further comprises a processing unit 22, the processing unit 22 is electrically connected on the circuit board 21, and is electrically connected with the USB Type-C connector 2 and the plurality of transferring terminals 23 through the connecting line 20. In this embodiment, the processing unit 22 may be any type of protecting components for providing the safety of the USB Type-C connector 2 during signal transmission. In the embodiment shown in FIG. 1, the processing unit 22 is arranged on the top face 211 of the circuit board 21. However, in other embodiment, the processing unit 22 may be arranged on the bottom face 212 of the circuit board 21 either. More specific, two processing units 22 may be respectively arranged on the top face 211 and the bottom face 212 of the circuit board 21, but not limited thereto.

Figure 4:
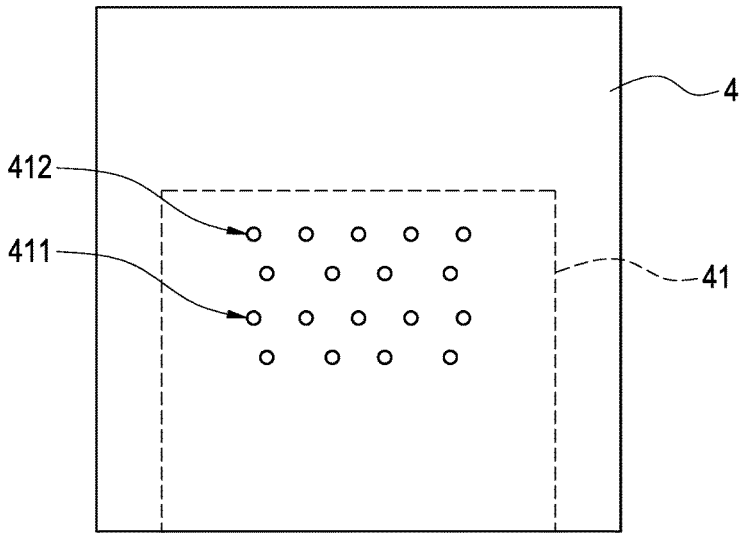
FIG. 4 is a schematic diagram showing mainboard inserting holes of a first embodiment according to the present invention.

Please refer to FIG. 4; FIG. 4 is a schematic diagram showing mainboard inserting holes of a first embodiment according to the present invention. An embodiment shown in FIG. 4 discloses the mainboard 4 adopted by an external computer apparatus (not shown). The mainboard 4 comprises a connecting area 41, the connecting area 41 comprises a first inserting hole set 411 and a second inserting hole set 412, wherein the first inserting hole set 411 comprises nine inserting holes, and the second inserting hole set 412 also comprises nine inserting holes.

The connecting area 41 is used to connect with a composite electronic connector which is combined by two traditional USB 3.0 Type-A connectors, wherein the two USB 3.0 Type-A connectors are respectively comprising nine connection terminals, which are respectively corresponding to the first inserting hole set 411 and the second inserting hole set 412.

In one aspect of the invention, the circuit board 21, the connecting line 20 and the plurality of transferring terminals 23 are used to integrate a plurality of output pins of the USB Type-C connector 2 into an amount that is less than twenty-four and meets the amount of a standard USB Type-A connector (the amount in the embodiment shown in FIG. 1 is nine for example). Therefore, though the connector assembly 1 disclosed in each embodiment of the present invention is composite by one of the USB Type-C connector 2 and one of the USB Type-A connector 3, but the connector assembly 1 may be directly connected to the connecting area 41 of the mainboard 4 (wherein the USB Type-A connector 3 is corresponding to the first inserting hole set 411 and the USB Type-C connector 2 is corresponding to the second inserting hole set 412), i.e., the mainboard 4 doesn't need to change its pin definition and circuit design and it may directly connect with the connector assembly 1 of the present invention for using the USB Type-C connector 2 of the connector assembly 1, so as to reduce additional cost of development and manufacture.

Figure 5:
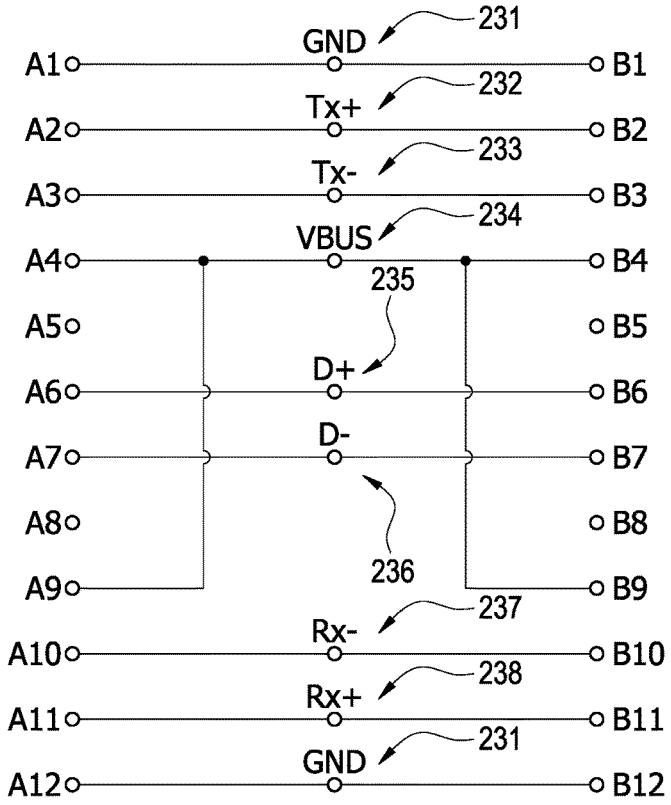
FIG. 5 is a schematic diagram showing circuit connection of a first embodiment according to the present invention.

FIG. 5 is a schematic diagram showing circuit connection of a first embodiment according to the present invention. The embodiment shown in FIG. 5 discloses how the connecting line 20 integrates the twenty-four golden finger of the USB Type-C connector 2 into nine transferring terminals 23 that is corresponding to USB 3.0 Type-A standard. The standard pin definition of the USB Type-C connector 2 is described as the following table:

| A1 | A2 | A3 | A4 | A5 | A6 | A7 | A8 | A9 | A10 | A11 | A12 |
|---|---|---|---|---|---|---|---|---|---|---|---|
| GND | Tx1+ | Tx1− | VBUS | CC1 | D+ | D− | SBU1 | VBUS | Rx2− | Rx2+ | GND |
| B12 | B11 | B10 | B9 | B8 | B7 | B6 | B5 | B4 | B3 | B2 | B1 |
| GND | Rx1+ | Rx1− | VBUS | SBU2 | D− | D+ | CC2 | VBUS | Tx2− | Tx2+ | GND |

The above table shows the well-known terminal standard of a standard USB Type-C connector, the difference between the above standard and the disclosure of the present invention is that the USB Type-C connector 2 in each embodiment of the present invention uses the circuit board 21 to substitute for the tongue of the standard USB Type-C connector, and uses the twenty-four golden fingers to substitute for the twenty-four connection terminals of the standard USB Type-C connector.

As the above disclosure, A1 to A12 of the above table indicates the signal definition of the twelve upper golden fingers 213 of the USB Type-C connector 2, B1 to B12 of the above table indicates the signal definition of the twelve lower golden fingers 214 of the USB Type-C connector 2, wherein, GND indicates a grounding golden finger, Tx1+ and Tx2+ indicate positive transmitting golden fingers, Tx1− and Tx2− indicate negative transmitting golden fingers, VBUS indicates a power golden finger, D+ indicates a positive data golden finger, D− indicates a negative data golden finger, Rx1+ and Rx2+ indicate positive receiving golde fingers, Rx1− and Rx2− indicate negative receiving golden fingers. Furthermore, CC1, CC2, SBU1 AND SBU2 are irrelated with the exemplary embodiments of the present invention, no more discussion is needed here.

In one of the exemplary embodiments, the nine transferring terminals 23 comprise two grounding terminals 231 (GND), a positive transmitting terminal 232 (Tx+), a negative transmitting terminal 233 (Tx−), a power terminal 234 (VBUS), a positive data terminal 235 (D+), a negative data terminal 236 (D−), a negative receiving terminal 237 (Rx−) and a positive receiving terminal 238 (Rx+).

As shown in FIG. 5, among the nine transferring terminals 23, the two grounding terminals 231 are respectively connected with the first golden finger and the twelfth golden finger (A1, A12) from the top face 211 and the first golden finger and the twelfth golden finger (B1, B12) from the bottom face 212 of the circuit board 21; the positive transmitting terminal 232 is connected with both the second golden finger (A2) from the top face 211 and the second golden finger (B2) from the bottom face 212 of the circuit board 21; the negative transmitting terminal 233 is connected with both the third golden finger (A3) from the top face 211 and the third golden finger (B3) from the bottom face 212 of the circuit board 21; the power terminal 234 is connected with the fourth golden finger and the ninth golden finger (A4, A9) from the top face 211 and the fourth golden finger and the ninth golden finger (B4, B9) from the bottom face 212 of the circuit board 21; the positive data terminal 235 is connected with both the sixth golden finger (A6) from the top face 211 and the sixth golden finger (B6) from the bottom face 212 of the circuit board 21; the negative data terminal 236 is connected with both the seventh golden finger (A7) from the top face 211 and the seventh golden finger (B7) from the bottom face 212 of the circuit board 21; the negative receiving terminal 237 is connected with both the tenth golden finger (A10) from the top face 21 and the tenth golden finger (B10) from the bottom face 212 of the circuit board 21; the positive receiving terminal 238 is connected with both the eleventh golden finger (A11) from the top face 211 and the eleventh golden finger (B11) from the bottom face 212 of the circuit board 21. In one of the exemplary embodiments, the plurality of transferring terminals 23 are not connecting with the fifth golden finger (A5) and the eighth golden finger (A8) from the top face 211 and the fifth golden finger (B5) and the eighth golden finger (B8) from the bottom face 212 of the circuit board 21.

According to the aforementioned configuration, no matter a connector plug (not shown) inserted with the USB Type-C connector 2 is obverse or reverse, the mainboard 4 may establish a communication with an electronic device (not shown) connected with the connector plug through the USB Type-C connector 2. Also, the mainboard 4 may connect with and use the connector assembly 1 of the present invention through the tranditonal connecting area 41, the circuit arrangemention of the mainboard 4 is unnecessary to be changed, which is very convenient.

Figure 6:
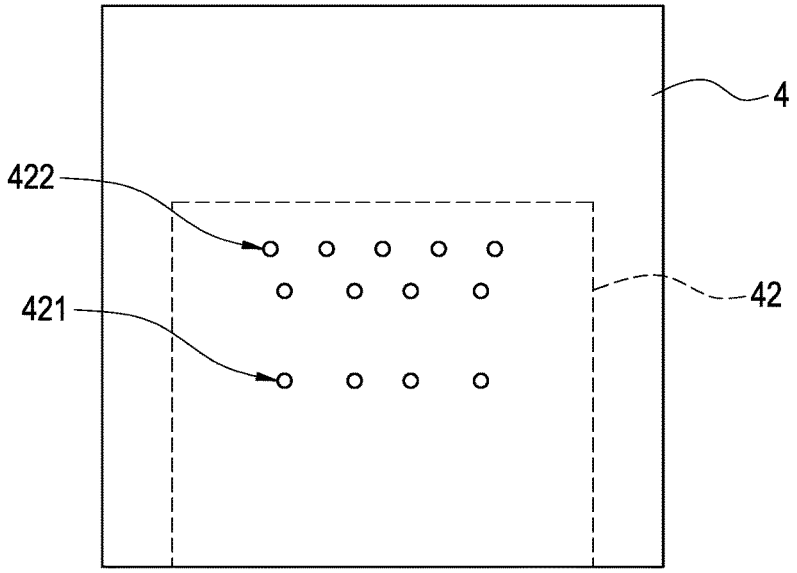
FIG. 6 is a schematic diagram showing mainboard inserting holes of a second embodiment according to the present invention.
Figure 7:
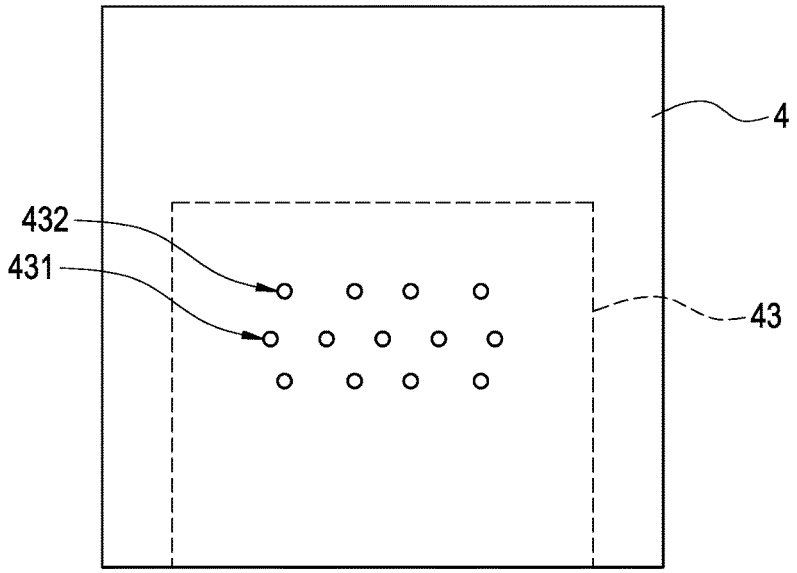
FIG. 7 is a schematic diagram showing mainboard inserting holes of a third embodiment according to the present invention.
Figure 8:
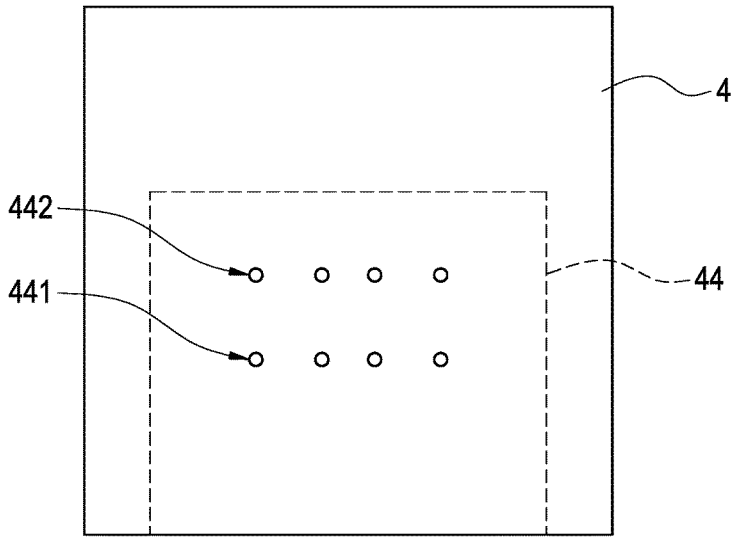
FIG. 8 is a schematic diagram showing mainboard inserting holes of a fourth embodiment according to the present invention.

Please refer to FIG. 6, FIG. 7 and FIG. 8; FIG. 6 is a schematic diagram showing mainboard inserting holes of a second embodiment according to the present invention. FIG. 7 is a schematic diagram showing mainboard inserting holes of a third embodiment according to the present invention, FIG. 8 is a schematic diagram showing mainboard inserting holes of a fourth embodiment according to the present invention. One of the exemplary embodiments shown in FIG. 6 discloses other connecting area 42 on the mainboard 4, the connecting area 42 comprises a first inserting hole set 421 and a second inserting hole set 422. In this embodiment, the first inserting hole set 421 comprises four inserting holes, and the second inserting hole set 422 comprises nine inserting holes.

In particular, the connecting area 42 is used to connect with a traditional composite electronic connector which is combined by a USB 2.0 Type-A connector and a USB 3.0 Type-A connector, wherein the four terminals of the USB 2.0 Type-A connector are respectively corresponding to the four inserting holes of the first inserting hole set 421, and the nine terminals of the USB 3.0 Type-A connector are respectively corresponding to the nine inserting holes of the second inserting hole set 422. In one of the exemplary embodiments, the USB Type-A connector 3 adopted in the connector assembly 1 may be a USB 2.0 Type-A connector comprising four connection terminals. Therefore, the connector assembly 1 may connect with the mainboard 4 through the connecting area 42.

One of the exemplary embodiments shown in FIG. 7 discloses another connecting area 43 on the mainboard 4, the connecting area 43 comprises a first inserting hole set 431 and a second inserting hole set 432. In this embodiment, the first inserting hole set 431 comprises nine inserting holes, and the second inserting hole set 432 comprises four inserting holes. One of the exemplary embodiments shown in FIG. 8 discloses another connecting area 44 on the mainboard 4, the connecting area 44 comprises a first inserting hole set 441 and a second inserting hole set 442. In this embodiment, the first inserting hole set 441 comprises four inserting holes, and the second inserting hole set 442 also comprises four inserting holes.

In particular, the connecting area 43 is used to connect with a traditional composite electronic connector which is combined by a USB 3.0 Type-A connector and a USB 2.0 Type-A connector, wherein the nine terminals of the USB 3.0 Type-A connector are respectively corresponding to the nine inserting holes of the first inserting hole set 431, and the four terminals of the USB 2.0 Type-A connector are respectively corresponding to the four inserting holes of the second inserting hole set 432. Besides, the connecting area 44 is used to connect with a traditional composite electronic connector which is combined by two USB 2.0 Type-A connectors, wherein the two USB Type-A connectors are respectively corresponding to the two inserting hole sets 441, 442.

As mentioned above, in order to connect with the connecting area 43 or the connecting area 44 of the mainboard 4, no matter the USB Type-A connector 3 of the connector assembly 1 is the USB 2.0 Type-A connector comprising four connection terminals or the UB 3.0 Type-A connector comprising nine connection terminals, the connector assembly 1 needs to integrate the twenty-four golden fingers of the USB Type-C connector 2 into four outputting terminals which satisfies USB 2.0 Type-A standard (i.e., the amount of the plurality of transferrting terminals 23 is four), and the plurality of transferrting terminals 23 are respectively corresponding to the four inserting holes of the second inserting hole set 432 or 442.

Figure 9:
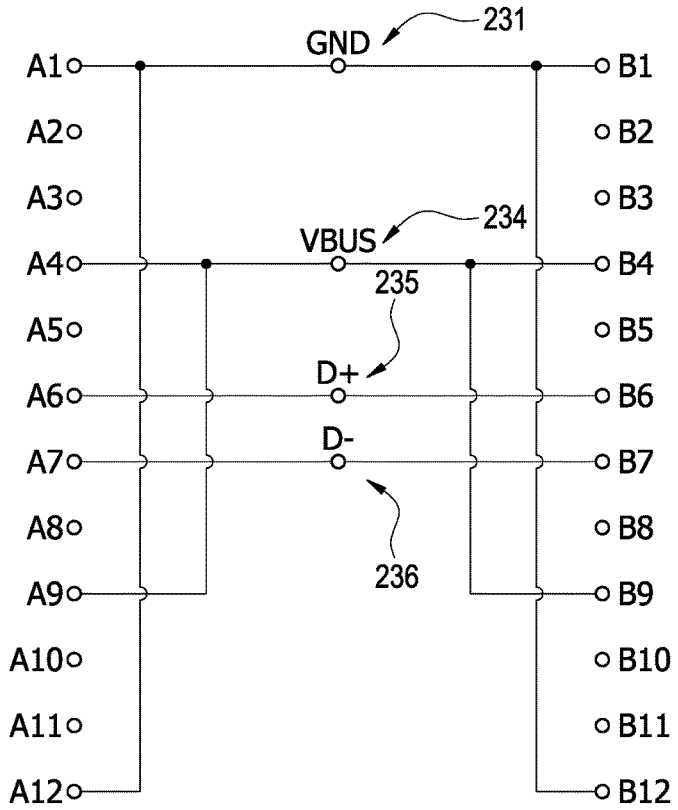
FIG. 9 is a schematic diagram showing circuit connection of a second embodiment according to the present invention.

FIG. 9 is a schematic diagram showing circuit connection of a second embodiment according to the present invention. In one of the exemplary embodiments shown in FIG. 9, the amount of the plurality of transferring terminals 23 of the connector assembly 1 may be four, and the four transferring terminals 23 comprise the grounding terminal 231, the power terminal 234, the positive data terminal 235 and the negative data terminal 236.

In this embodiment, the grounding terminal 231 is connected with the first golden finger and the twelfth golden finger (A1, A12) from the top face 211 and the first golden finger and the twelfth golden finger (B1, B12) from the bottom face 212 of the circuit board 21; the power terminal 234 is connected with the fourth golden finger and the ninth golden finger (A4, A9) from the top face 211 and the fourth golden finger and the ninth golden finger (B4, B9) from the bottom face 212 of the circuit board 21; the positive data terminal 235 is connected with both the sixth golden finger (A6) from the top face 211 and the sixth golden finger (B6) from the bottom face 212 of the circuit board 21; the negative data terminal 236 is connected with both the seventh golden finger (A7) from the top face 211 and the seventh golden finger (B7) from the bottom face 212 of the circuit board 21.

It should be mentioned that the second golden finger, the third golden finger, the fifth golden finger, the eighth golden finger, the tenth golden finger, the eleventh golden finger (A2, A3, A5, A8, A10, A11) from the top face 211 and the second golden finger, the third golden finger, the fifth golden finger, the eighth golden finger, the tenth golden finger, the eleventh golden finger (B2, B3, B5, B8, B10, B11) from the bottom face 212 of the circuit board 21 of the USB Type-C connector 2 are irrelated to USB 2.0 Type-A standard, it results in that the aforementioned golden fingers may not be connected with the plurality of transferring terminals 23 in the embodiment.

According to the disclosed embodiments of the present invention, the mainboard 4 may directly connect with the connector assembly 1 through the current existed USB 2.0 Type-A standard adopted pins and/or USB 3.0 Type-A standard adopted pins, so as to use the USB Type-C connector 2 and the USB Type-A connector 3 of the connector assembly 1, which is very convenient.

As the skilled person will appreciate, various changes and modifications can be made to the described embodiment. It is intended to include all such variations, modifications and equivalents which fall within the scope of the present invention, as defined in the accompanying claims.

What is claimed is:

1. A composite electronic connector, comprising:

an insulating housing;

a USB Type-C connector, arranged in the insulating housing and comprising:

a circuit board arranged with twenty-four golden fingers in one end;

a plurality of transferring terminals, one end of the plurality of transferring terminals being electrically connected with other end of the circuit board and other end of the plurality of transferring terminals protruding from a bottom of the insulating housing; and a connecting line, arranged on the circuit board and electrically connected with the twenty-four golden fingers and the plurality of transferring terminals, and the connecting line integrating signal transmitted by the USB Type-C connector through the twenty-four golden fingers into USB Type-A standard adopted outputting signal and transmitting the outputting signal externally through the plurality of transferring terminals and a USB Type-A connector, arranged approximately to the USB Type-C connector;

wherein the insulating housing comprises a front face, the USB Type-C connector is arranged in the insulating housing and exposed out of the front face, and size and shape of the front face are corresponding to size and shape of a port of a standard USB Type-A connector and are different from a port of a standard USB Type-C connector, and wherein an amount of the plurality of transferring terminals is less than twenty-four and the plurality of transferring terminals are corresponding to an amount of connection terminals of the USB Type-A connector, such that the USB Type-C connector is able to directly connect to USB Type-A adopted inserting holes on an external mainboard.

2. The composite electronic connector in claim 1, wherein the circuit board comprises a top face and a bottom face, the twenty-four golden fingers comprise twelve upper golden fingers arranged on the top face and twelve lower golden fingers arranged on the bottom face.

3. The composite electronic connector in claim 1, wherein the USB Type-A connector is a USB 2.0 Type-A connector comprising four connection terminals or a USB 3.0 Type-A connector comprising nine connection terminals.

4. The composite electronic connector in claim 2, wherein an amount of the plurality of transferring terminals is nine, and the nine transferring terminals comprise a power terminal (VBUS), a positive data terminal (D+), a negative data terminal (D−), a positive transmitting terminal (Tx+), a negative transmitting terminal (Tx−), a positive receiving terminal (Rx+), a negative receiving terminal (Rx−), and two grounding terminals (GND).

5. The composite electronic connector in claim 4, wherein the power terminal is connected with a fourth golden finger and a ninth golden finger from the top face and a fourth golden finger and a ninth golden finger from the bottom face of the circuit board, the positive data terminal is connected with a sixth golden finger from the top face and a sixth golden finger from the bottom face of the circuit board, the negative data terminal is connected with a seventh golden finger from the top face and a seventh golden finger from the bottom face of the circuit board, the positive transmitting terminal is connected with a second golden finger from the top face and a second golden finger from the bottom face of the circuit board, the negative transmitting terminal is connected with a third golden finger from the top face and a third golden finger from the bottom face of the circuit board, the positive receiving terminal is connected with an eleventh golden finger from the top face and an eleventh golden finger from the bottom face of the circuit board, the negative receiving terminal is connected with a tenth golden finger from the top face and a tenth golden finger from the bottom face of the circuit board, and the two grounding terminals are respectively connected with a first golden finger and a twelfth golden finger from the top face and a first golden finger and a twelfth golden finger from the bottom face of the circuit board.

6. The composite electronic connector in claim 2, wherein an amount of the plurality of transferring terminals is four, and the four transferring terminals comprise a power terminal (VBUS), a positive data terminal (D+), a negative data terminal (D−), and a grounding terminal (GND).

7. The composite electronic connector in claim 6, wherein the power terminal is connected with a fourth golden finger and a ninth golden finger from the top face and a fourth golden finger and a ninth golden finger from the bottom face of the circuit board, the positive data terminal is connected with a sixth golden finger from the top face and a sixth golden finger from the bottom face of the circuit board, the negative data terminal is connected with a seventh golden finger from the top face and a seventh golden finger from the bottom face of the circuit board, and the grounding terminal is connected with a first golden finger and a twelfth golden finger from the top face and a first golden finger and a twelfth golden finger from the bottom face of the circuit board.

8. The composite electronic connector in claim 1, wherein the insulating housing comprises a container, the circuit board is horizontally arranged in the container, and the USB Type-A connector is horizontally arranged below the USB Type-C connector.

9. The composite electronic connector in claim 1, further comprising a processing unit, electrically connected with the circuit board, and electrically connected with the twenty-four golden fingers and the plurality of transferring terminals through the connecting line.

* * * * *